US007584593B2

(12) United States Patent
Murray

(10) Patent No.: US 7,584,593 B2
(45) Date of Patent: Sep. 8, 2009

(54) METHOD AND APPARATUS FOR OPENING A FLEXIBLE POUCH USING OPENING FINGERS

(75) Inventor: R. Charles Murray, Sarasota, FL (US)

(73) Assignee: Pouch Pac Innovations, LLC, Sarasota, FL (US)

( * ) Notice: Subject to any disclaimer, the term of this patent is extended or adjusted under 35 U.S.C. 154(b) by 0 days.

(21) Appl. No.: 11/933,784

(22) Filed: Nov. 1, 2007

(65) Prior Publication Data

US 2008/0098697 A1 May 1, 2008

Related U.S. Application Data

(60) Provisional application No. 60/863,864, filed on Nov. 1, 2006.

(51) Int. Cl.
*B65B 43/26* (2006.01)

(52) U.S. Cl. ..... 53/564; 53/468; 53/570; 493/309; 493/313

(58) Field of Classification Search ..... 53/468, 53/469, 564, 567, 570, 381.3, 385.1, 386.1; 493/309, 313

See application file for complete search history.

(56) References Cited

U.S. PATENT DOCUMENTS

| | | | | |
|---|---|---|---|---|
| 733,449 | A | 7/1903 | Willsie | |
| 2,008,216 | A | 7/1935 | Lombi | |
| 2,106,028 | A | 1/1938 | Heimsch et al. | |
| 2,189,174 | A | 2/1940 | Hohl | |
| 2,703,671 | A | 3/1955 | Kindseth | |
| 2,759,643 | A | 8/1956 | Dahlin | |
| 3,010,619 | A | 11/1961 | Gronemeyer et al. | |
| 3,286,005 | A | 11/1966 | Cook | |
| 3,304,977 | A | 2/1967 | Hammons | |
| 3,855,907 | A | 12/1974 | Johnson et al. | |
| 3,924,008 | A | 12/1975 | Ford et al. | |
| 3,938,658 | A | 2/1976 | Rohde | |
| 4,078,717 | A | 3/1978 | Stearley | |
| 4,248,032 | A * | 2/1981 | Woods et al. | 53/570 |
| 4,326,568 | A | 4/1982 | Burton et al. | |
| 4,361,235 | A | 11/1982 | Gautier et al. | |
| 4,423,583 | A * | 1/1984 | Carey | 52/373 |

(Continued)

FOREIGN PATENT DOCUMENTS

| | | |
|---|---|---|
| EP | 1577223 | 9/2005 |

(Continued)

*Primary Examiner*—Hemant M Desai
(74) *Attorney, Agent, or Firm*—Gifford, Krass, Sprinkle, Anderson & Citkowski, P.C.

(57) ABSTRACT

An apparatus, machine and method for opening a flexible pouch includes a pair of opposed side grippers each holding a side of the pouch. A pair of opposed panel grippers each hold an upper edge of the pouch. The side grippers are displaced inwardly towards each other and the panel grippers are displaced outwardly away from each other to partially open the pouch. A pair of pouch opening fingers are displaceable between a raised position above the pouch and a lowered position within the pouch. The pouch opening fingers are open in the raised position and closed after lowered into the lowered position, to grip the wall of the pouch. The pair of pouch opening fingers move together a predetermined distance in an outboard direction to fully separate the pouch walls.

11 Claims, 10 Drawing Sheets

U.S. PATENT DOCUMENTS

| | | | | |
|---|---|---|---|---|
| 4,498,591 | A | 2/1985 | Smith, II | |
| 4,519,499 | A | 5/1985 | Stone et al. | |
| 4,690,304 | A | 9/1987 | Morel et al. | |
| 4,717,046 | A | 1/1988 | Brogli et al. | |
| 4,808,010 | A | 2/1989 | Vogan et al. | |
| 4,848,421 | A | 7/1989 | Froese et al. | |
| 4,861,414 | A | 8/1989 | Vogan et al. | |
| 4,867,131 | A | 9/1989 | van der Merwe et al. | |
| 4,892,512 | A | 1/1990 | Branson | |
| 4,905,452 | A | 3/1990 | Vogan et al. | |
| 4,998,671 | A | 3/1991 | Leifheit | |
| 4,999,978 | A | 3/1991 | Kohlbach et al. | |
| 5,058,364 | A * | 10/1991 | Seiden et al. | 53/455 |
| 5,104,008 | A | 4/1992 | Crisci | |
| 5,222,535 | A | 6/1993 | Roders | |
| 5,267,591 | A | 12/1993 | Wakabayashi et al. | |
| 5,377,873 | A | 1/1995 | Minnette | |
| 5,433,526 | A | 7/1995 | Wild et al. | |
| 5,465,707 | A | 11/1995 | Fulcher et al. | |
| 5,485,714 | A | 1/1996 | Montalvo | |
| 5,492,219 | A | 2/1996 | Stupar | |
| 5,836,445 | A | 11/1998 | Provonchee | |
| 5,845,466 | A | 12/1998 | Laudenberg et al. | |
| 5,855,544 | A | 1/1999 | Buchanan | |
| 5,906,438 | A | 5/1999 | Laudenberg et al. | |
| 5,911,340 | A | 6/1999 | Uematsu et al. | |
| 5,954,432 | A | 9/1999 | Laudenberg et al. | |
| 6,039,218 | A | 3/2000 | Beck | |
| 6,065,651 | A | 5/2000 | Tedeschi, Jr. et al. | |
| 6,116,231 | A | 9/2000 | Sabin et al. | |
| 6,199,601 | B1 | 3/2001 | Laudenberg et al. | |
| 6,217,497 | B1 | 4/2001 | Laudenberg et al. | |
| 6,241,122 | B1 | 6/2001 | Araki et al. | |
| 6,276,788 | B1 | 8/2001 | Hilton | |
| 6,422,753 | B1 | 7/2002 | Thomas | |
| 6,439,429 | B1 | 8/2002 | Gross | |
| 6,490,846 | B2 * | 12/2002 | Koppe | 53/459 |
| 6,513,516 | B2 | 2/2003 | Sabin et al. | |
| D474,682 | S | 5/2003 | Berman | |
| 6,571,994 | B1 | 6/2003 | Adams et al. | |
| 6,640,801 | B2 | 11/2003 | Sabin et al. | |
| 6,651,848 | B1 | 11/2003 | Redmond | |
| 6,662,532 | B1 * | 12/2003 | Droog et al. | 53/459 |
| 6,719,015 | B2 | 4/2004 | Murray | |
| 6,935,492 | B1 | 8/2005 | Loeb | |
| 6,981,614 | B2 | 1/2006 | Niggemyer | |
| 2004/0206777 | A1 | 10/2004 | Mertens | |
| 2005/0040181 | A1 | 2/2005 | Kurosawa et al. | |
| 2006/0196152 | A1 * | 9/2006 | Wild et al. | 53/459 |
| 2007/0017187 | A1 * | 1/2007 | Chikatani | 53/459 |
| 2007/0144113 | A1 | 6/2007 | Murray | |

FOREIGN PATENT DOCUMENTS

| | | |
|---|---|---|
| JP | 10175649 | 6/1998 |
| JP | 11049186 | 2/1999 |
| JP | 11091807 | 4/1999 |
| JP | 2000281089 | 10/2000 |
| JP | 2000335594 | 12/2000 |
| JP | 2001048200 | 2/2001 |
| JP | 2001122206 | 5/2001 |
| WO | WO-2004054888 | 7/2004 |

* cited by examiner

METHOD AND APPARATUS FOR OPENING A FLEXIBLE POUCH USING OPENING FINGERS

CROSS REFERENCE TO RELATED APPLICATION

This application claims priority of U.S. Provisional Patent Application Ser. No. 60/863,864 filed Nov. 1, 2006, which is incorporated herein by reference.

BACKGROUND OF THE INVENTION

1. Field of the Invention

The present invention relates generally to a flexible pouch for packaging products, and more particularly to a method and apparatus for opening a flexible pouch using a pair of opening fingers.

2. Description of the Related Art

Various types of disposable, portable containers are known in the art for storing a fluid or dry product, such as a liquid, granular material, powder or the like. An example of such a container is a flexible pouch. Consumers prefer the convenience of flexible pouches over other types of containers, due to their shape, size, shelf life and storage adaptability. Manufacturers recognize the packaging benefits of a flexible pouch, since the pouch can be formed and filled on the same manufacturing line. An example of a method and apparatus for filling a flexible pouch with a product is disclosed in commonly assigned U.S. Pat. No. 6,199,601, which is incorporated herein by reference.

The pouch may be formed through conventionally available manufacturing techniques using a machine. Various styles of machines can be utilized, such as a form machine, or fill-seal machine, or form-fill-seal machine. The machine can have various configurations, such as horizontal, vertical or flat bed, or the like, as well as a single or multiple lanes. The machine can include various stations, with a particular operation or operations taking place at each station. The formed pouch may be opened, filled, sealed and finished as required for a particular style of pouch. Various techniques are used to open the pouch, such as grippers, diving rods, or gas or a combination thereof.

While all of these opening techniques work, the pouch may not be fully opened prior to filling, depending on the configuration of the pouch. Thus, there is a need in the art for an improved apparatus and method of reliably opening a flexible pouch using a pair of opening fingers, in order to fully open the pouch and fill the pouch with a product.

SUMMARY OF THE INVENTION

Accordingly, an apparatus, method and machine for opening a flexible pouch are provided. The apparatus is an opening station that includes a pair of opposed side grippers each holding a side of the pouch and operatively connected to an actuating mechanism. A pair of opposed panel grippers each hold an upper edge of the pouch. The actuating mechanism simultaneously displaces the side grippers inwardly towards each other and the panel grippers outwardly away from each other to partially open the pouch. A pair of pouch opening fingers are displaceable between a raised position above the pouch and a lowered position within the pouch. The pair of pouch opening fingers are open in the raised position and closed after the pouch is lowered into the pouch to grip the wall of the pouch. The pouch opening fingers move together a predetermined distance in an outboard direction to fully separate the pouch walls.

The machine for opening, filling with a product and closing a flexible pouch contained within the pouch includes a receiving station for receiving an unfilled flexible pouch having a wall and an opening means integrally formed in the wall for accessing a product. The machine includes a pair of opposed side grippers each holding a side of the pouch for transporting the pouch between stations of the machine. The machine includes an opening station having an actuating mechanism and a pair of opposed panel grippers operatively connected to an actuating mechanism that each hold an upper edge of the pouch, and a pair of pouch opening fingers operatively connected to the opening station actuating mechanism that are displaceable between a raised position above the pouch and a lowered position within the pouch, and an outboard direction to fully open the pouch. The machine further includes a filling station for filling the opened pouch with the product and a closing station for closing the pouch opening means.

The method includes the steps of providing a formed pouch having a wall and an opening means integrally formed in the wall for accessing a product contained within the pouch. The pouch is partially opened using a pair of opposed side grippers, each holding a side of the pouch, a pair of opposed panel grippers, each holding an upper edge of the pouch. The side grippers are displaced inwardly towards each other and the panel grippers are displaced outwardly away from each other to partially open the pouch. The pouch is fully opened by displacing a pair of pouch opening fingers into the partially opened pouch from a raised position above the pouch to a lowered position within the pouch. The pouch opening fingers are open in the raised position, and closed after being lowered into the pouch, to grip the wall of the pouch, and the pouch opening fingers move together in an outboard direction to fully open the pouch.

One advantage of the present invention is that an improved apparatus and method and machine for opening a flexible pouch for filling with a product using a pouch opening finger is provided. Another advantage of the present invention is that an apparatus, method and machine for making a flexible pouch is provided that utilizes a pair of fingers to open the pouch prior to filling. Still another advantage of the present invention is that an apparatus, method and machine for making a flexible pouch is provided that includes a pouch opening device or plunger, to more fully and reliably opens a pouch with a zipper. A further advantage of the present invention is that an apparatus, method and machine for making a flexible pouch with a pouch opening finger is provided that is cost effective to manufacture and implement. Still yet a further advantage of the present invention is that an apparatus, method and machine is provided that can be utilized with a multi-compartment pouch.

Other features and advantages of the present invention will be readily appreciated, as the same becomes better understood after reading the subsequent description taken in conjunction with the accompanying drawings.

DETAILED DESCRIPTION OF THE PREFERRED EMBODIMENTS

Figure 1:
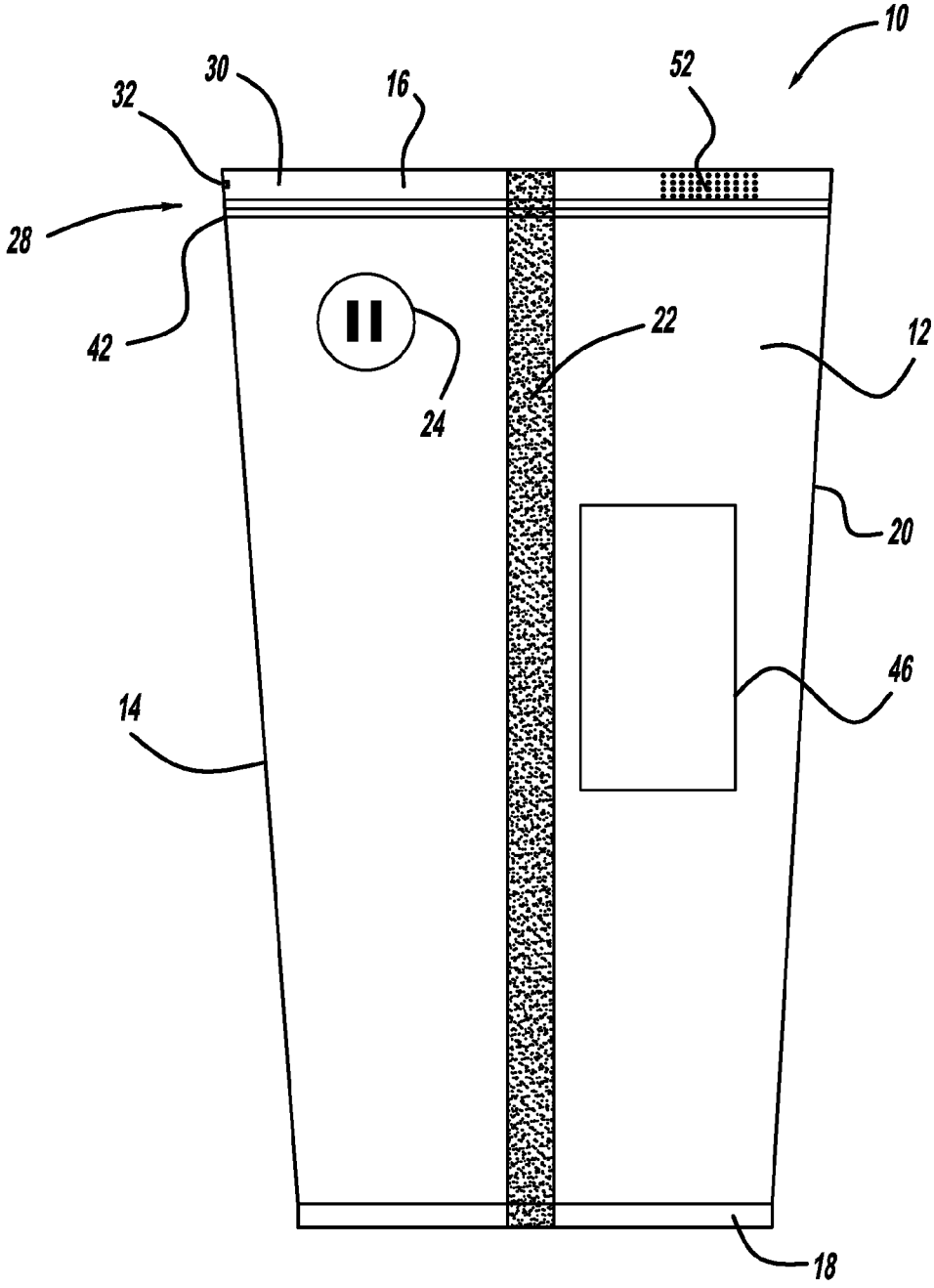
FIG. 1 is an elevational view of a flexible pouch with a zipper fitment, according to the present invention.
Figure 2:
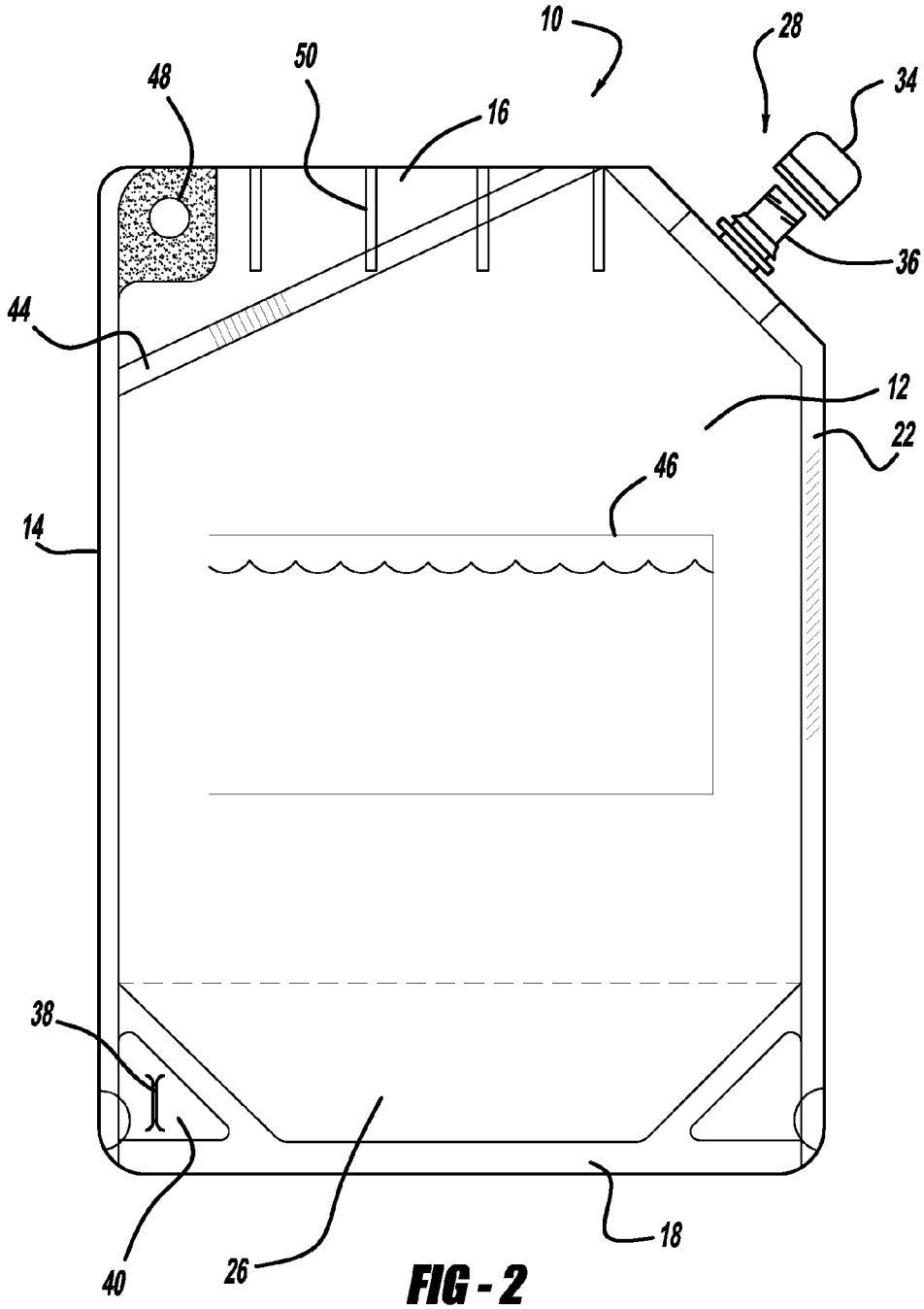
FIG. 2 is an elevational view of a flexible pouch with a spout fitment, according to the present invention.

Referring to FIGS. 1-2, a flexible pouch 10 is illustrated. The filled pouch 10 may assume various shapes, such as cylindrical, cube, conical, spherical, or the like. The type of product and usage of the pouch influences the shape. The type of product is unlimited, and could have a solid or a liquid form. The pouch 10 may form one compartment for the product. Alternatively, the pouch 10 may include multiple discrete compartments. An example of such a pouch is disclosed in commonly assigned U.S. patent application Ser. No. 11/367,613, which is incorporated herein by reference.

The flexible pouch 10 is preferably formed from a roll of flexible, preprinted laminate material. The choice of laminate material is nonlimiting, and is influenced by factors such as the product contained in the pouch 10, the shape of the pouch or the anticipated use of the pouch. Preferably, the laminate is either a three, four, five or more gauge material, and the outer layer is preprinted. It should be appreciated that a portion of the material may be a clear laminate as shown at 46, in order to view the contents of the pouch. For example, the laminate material may include at least one layer of virgin polyethylene terephthalate (PET) and at least one layer of aluminum foil (AL) and another layer such as EVOH, PET, polyethylene, or polypropylene or nylon or the like. The laminate may also include a metalized foil paper layer laminated to a cast polypropylene layer and another layer of PET, polyethylene or EVOH. It should be appreciated that there may be a fourth layer of nylon. Another material example includes a cast polypropylene (CPP) layer, a polyethylene (PET) layer, a foil (AL) layer, a nylon (ONO) layer and another CPP layer. Another example of a material structure is the use of nylon, foil, nylon, and cast polypropylene (ONO/AL/ONO/CPP) or CPP/NY/AL/CPP. A further example of a laminate material structure is CPP/AL/ONO/PE. This structure works well when the product has a short shelf life, and the nylon eliminates stretching or cracking of the AL layer. Advantageously, a pouch 10 made using the cast polypropylene laminate material retains its filled shape even as the product is removed from the pouch 10. It should be appreciated that if a filled carbonated pouch is stored at ambient temperature, the laminate will start to creep after a period of time, such as ten days. The laminate material may include an extrusion layer to contain "creepage" or "stretch" of the film after filling due to carbonation expansion, if the product is carbonated. The laminate material may include another layer of sealable material, such as LDPE, to facilitate sealing. In addition, the selected material may be organoleptic compliant in order to avoid the transfer of odor contaminants to the product, or product contamination during the shelf life period of the product.

The pouch 10 itself is defined by a panel, which may be formed using one or more sheets of material. The pouch 10 includes a front wall 12 and a back wall 14, and the edges of the panel are joined along a seam 22. With one sheet of material, the panel is manipulated so that its edges are joined together to form one seam. In another example of a pouch formed from two sheets of material, the pouch may be formed from two facing panels of material that are joined together along corresponding edges. These examples are merely illustrative of pouch shapes, and other pouch shapes may be utilized.

Further, the pouch generally defines an upper edge 16, an opposed lower edge 18, and at least one side edge 20 extending therebetween the upper and lower edges 16, 18. Any of the edges of the pouch may be shaped, such as linear or curvilinear or the like. For example, the upper edge may include an elongated spout or neck portion.

The edges of the pouch 10 may be sealed using heat or ultrasonics or by a combination of heat and ultrasonics. The pouch sealed edges form a seam 22. The seam 22 may be a fin-style seam, or a flat seam or the like. In an example of an overlap seam, a side edge seal may extend into a predetermined portion of the upper edge of the pouch, and a predetermined portion of the closing seal may overlap a predetermined portion of the side seal.

The pouch 10 may include a feature such as a sidewall. The sidewall 26 advantageously allows the pouch 10 to acquire another shape, such as cylindrical, or to stand upright. The sidewall 26 may be integrally formed in the panel as a gusset or a separate piece of material as an insert. The sidewall may be located between any of the edges, such as the side edges of the panel, between the lower edges, between the upper edges, or a combination thereof. The sidewall may have a shape. For example a sidewall in a side edge may be generally wider at the lower edge and tapering upwardly towards the upper edge, or be of a uniform dimension. The sidewall may be formed between the lower edges of the pouch 10 to provide a base for the pouch 10 to stand upright. A sidewall formed may also serve as an area for receiving an opening means, such as between an upper edge.

In an example of a sidewall forming a gusset between the lower edges of the pouch, the inner surface of the gusset may have a curvilinear shape, such as parabolic, concave or the like. For a pouch having a predetermined size the rounded shape may be advantageous in opening and filling of the pouch, since a reduced amount of air may be utilized to open the pouch, depending on the size of the pouch of seals.

The pouch includes an opening means 28 for accessing the contents or dispensing the contents from at least one compartment of the pouch 10. Various types of opening means 28 are known in the art for this purpose. It should be appreciated that the opening means 28 may be incorporated into the pouch 10 prior to filling the pouch 10. In addition, the pouch may be filled through an open edge of the pouch or through a fitment.

One example of an opening means is a tear-off portion 30. The tear-off portion 30 usually has an integral tear notch 32 and tear line, for removing a designated portion of the pouch to access the product contained therein. The tear-off portion 30 could be utilized in conjunction with another opening means, such as a zipper 42. The zipper opening means is a resealable zipper 42 that provides a hermetic seal through interlocking teeth, such as a zipper 42 that is sold under the name TopTite™. The zipper 42 may be used with another opening means. Another example of an opening means 28 is a weakened, straw-pierceable portion in the pouch for receiving a straw within at least one of the compartments. A further example of an opening means 28 is a pull tab covering an opening in the pouch. Still a further example of an opening means 28 is a fitment, such as a removable and replaceable cap 34 secured to a spout 36. The spout fitment 36 may be mounted to the top portion or side portion of the wall.

It should be appreciated that the flexible pouch 10 may advantageously include other features that are known in the art. For example, the pouch may include a tracking device 38 feature integrally located within the pouch 10 that includes electronic tracking information relevant to the pouch 10, as described in commonly assigned U.S. patent application Ser. No. 11/686,666, which is incorporated by reference. The tracking device 38 may be an electronic tag, such as a Radio Frequency Identification (RFID) transmitter. The tracking device 38 can store a predetermined amount of electronic information. An example of the information is unique tracking information for a particular package 10. For example, the tracking device 38 can provide information about the status of the pouch 10, such as physical location of the pouch 10, or age of the pouch 10 or the like. In addition, the tracking device 38 can be utilized for inventory control, delivery, purchase behavior, returns, pricing, and other tracking purposes. The tracking device 38 is in communication with a receiver (not shown) for reading the information. The receiver may be a computer system having a memory and a processor, a handheld device for receiving an RFID signal, or any other type of device capable of electronic communication with the tracking device 38. The receiver may be a transceiver capable of emitting a radio signal that initiates transmission of information from the tracking device 38. Although the packages are individually read, the RFID tag may be advantageously read at a faster rate than using a barcode in conjunction with a barcode scanner, since the packages are not physically scanned on an individual basis. In addition, the signal from the RFID tag may be advantageously read through an outer layer of material, such as a packaging material, or under various environmental conditions. Another advantage is that the tracking of the physical location of the package may be electronically monitored within a predetermined geographical range.

The tracking device 38 may be integrally embedded in the pouch 10. For example, a plurality of apertures may be punched in the folded area of the gusset 26 to reduce the amount of material in the gusset 26. The tracking device 38 may be inserted in an air pocket 40 formed within one of the gusset apertures. The inclusion of the tracking device 38 in the air pocket 40 is advantageous because it improves the signal strength of the tracking device 38. Alternatively, the tracking device 38 may be inserted in a sealed portion of the pouch, and an air pocket 40 is formed around the tracking device 38 during application of the seal. The tracking device may be integrally formed in the opening means.

The pouch 10 may include a feature such as an angled top seal 44 extending between a first side edge and a predetermined location on the upper edge 16 of the pouch. The angled top seal 44 facilitates the removal of product from the pouch 10 by directing the flow of the product towards the opening means. An example of such a pouch is disclosed in commonly assigned U.S. patent application Ser. No. 11/683,133 which is incorporated herein by reference.

The pouch 10 may include a feature such as a hanging aperture 48 located within an edge, such as an upper edge or side edge. The aperture 48 may have various shapes, such as round or curved. The pouch 10 may be supported by a support means, such as a hook that extends through the aperture 48. The pouch 10 may be hung for display or storage purposes. The positioning of the hanging aperture 48 above the angled top seal 44 or within a sealed portion prevents the contents of the pouch from leaking out through the aperture 46.

Another example of a feature is an insulating seal, which includes two seals separated by an airspace. The airspace creates a pocket of air that serves as an insulator. The pouch may include a feature such as a guide pocket formed in a wall 14, 16 of the pouch 10 prior to filling and sealing, to facilitate the separation of the front and back walls 14, 16 prior to the filling of the pouch 10. An example of such a pouch is disclosed in commonly assigned U.S. patent application Ser. No. 10/310,221. In a further example, the pouch may contain a rib 50 that adds strength or support or form to the body of the pouch. The rib 50 may be thermoformed. In still another example, the pouch may include a frangible seal. An example of a pouch with a frangible seal is disclosed in commonly assigned U.S. patent application Ser. No. 11/367,613 which is incorporated herein by reference.

The pouch may include a feature such as an integral vent means 24. The vent means, such as a valve, functions to exhaust a gas from the pouch. The gas may be formed within the package while heating the pouch. The valve may also be operable to respire gas formed in the pouch for other reasons, such as gas formed by decaying food or during freezing or the like. The valve remains tightly closed, until pressure from the gas, such as steam, reaches a predetermined pressure value. The valve opens and remains open, to release the gas or stream from the package in a controlled manner. Various types of valves are contemplated. For example, a tape may be used to cover a hole in the wall. Alternatively, a pressure relief device, such as that manufactured by PPI Technologies Global, Sarasota, Fla. model number P033F, may be utilized. Another example of a valve is disclosed in commonly assigned U.S. patent application Ser. Nos. 10/228,430 and 10/967,547 and PCT Patent Application No. PCT/US2004/34361 which is incorporated herein by reference.

The pouch may include a feature such as an ergonomic shape. An example of an ergonomically shaped pouch for a carbonated beverage is disclosed in commonly assigned U.S. patent application Ser. No. 11/454,241 which is incorporated herein by reference. The ergonomic shape may be achieved through carbonation as the pouch 10 is filled with a carbonated product, since the carbonation causes the pressure within the pouch to increase.

The flexible pouch 10 may include a feature such as an outer layer or sleeve (not shown) covering the outer surface of the pouch. The sleeve may be a label containing information about the product, such as a barcode or the like. The sleeve may cover only a portion of the pouch outer surface. Preferably, the sleeve is shrunk over the outer surface of the pouch 10 after the pouch 10 is formed and filled with the product. The sleeve is advantageous because it covers the side seam. It also adds one or more layers of material to strengthen the pouch and improve its durability. Various types of material may be utilized for the sleeve, such as paper or plastic including PET or PVC and the choice is non-limiting.

It is contemplated that the filled pouch 10 may undergo a secondary process. For example, the filled pouch may be refrigerated, frozen or otherwise modified for an extended shelf life. Alternatively, the filled pouch may be pasteurized for increased shelf life. Examples of pasteurized food products include dairy products such as milk, or meat products such as chicken or the like.

It is contemplated that these are merely examples of features and the flexible pouch 10 may incorporate any of the above-described features or any other feature, in any combination. In addition, the finished pouch may assume various shapes, such as cylindrical, cubical, spherical, conical, and hourglass or the like, as influenced by the type of product and intended usage of the pouch. It should further be appreciated that the designated upper edge and lower edge is merely for reference purposes.

After the pouch 10 is formed, the pouch 10 is available for filling, such as through an opening formed between open edges of the panels. After filling, the open edges of the pouch are sealed using a conventional method, such as heat sealing, or ultrasonic sealing or the like. The closing seal may be a single seal, or a wide double seal, as previously described. The sealed pouch is then available for shipping or additional processing.

Figure 3:
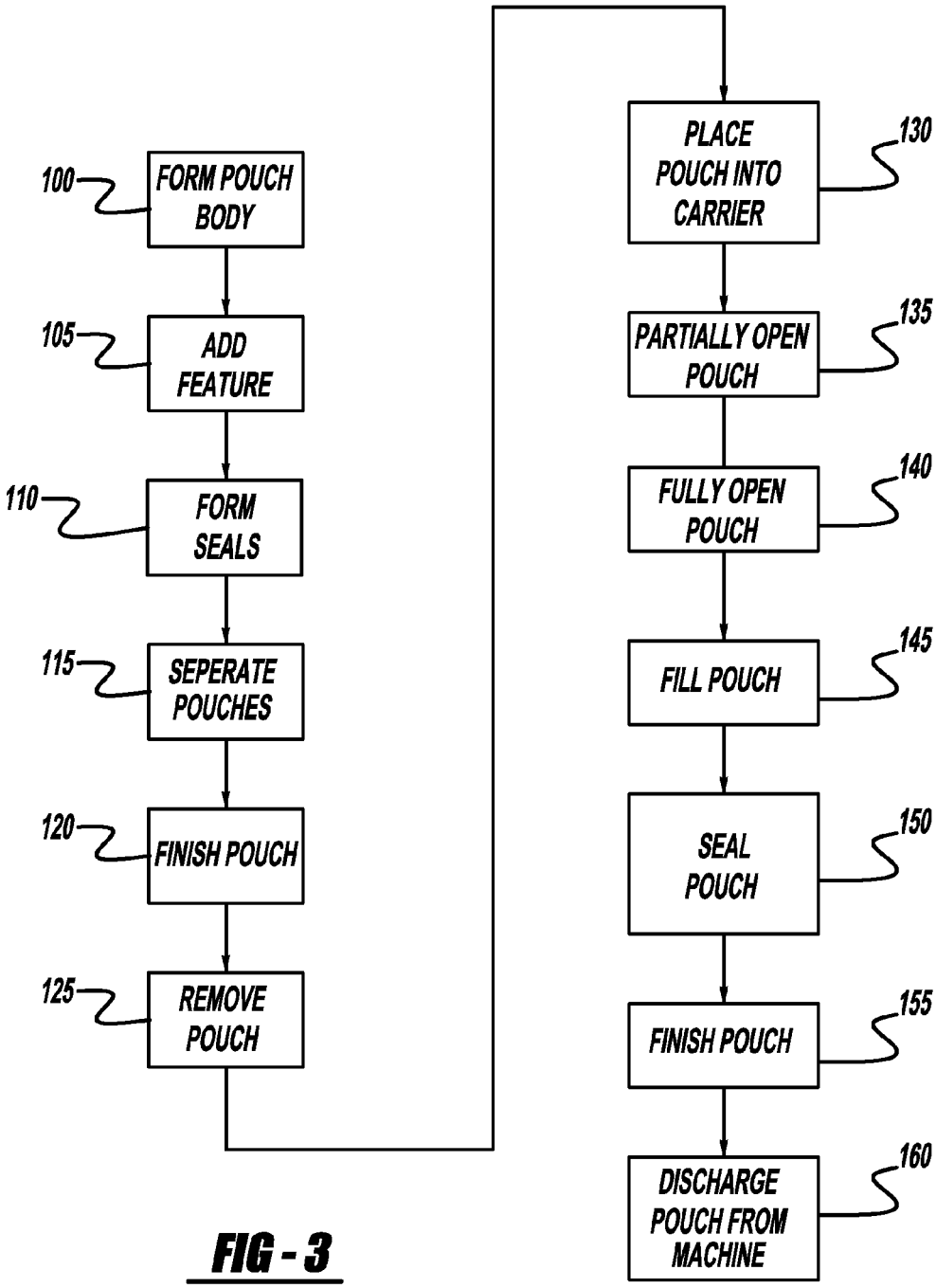
FIG. 3 is a flowchart illustrating a method of forming and filling the flexible pouch, according to the present invention.
Figure 4:
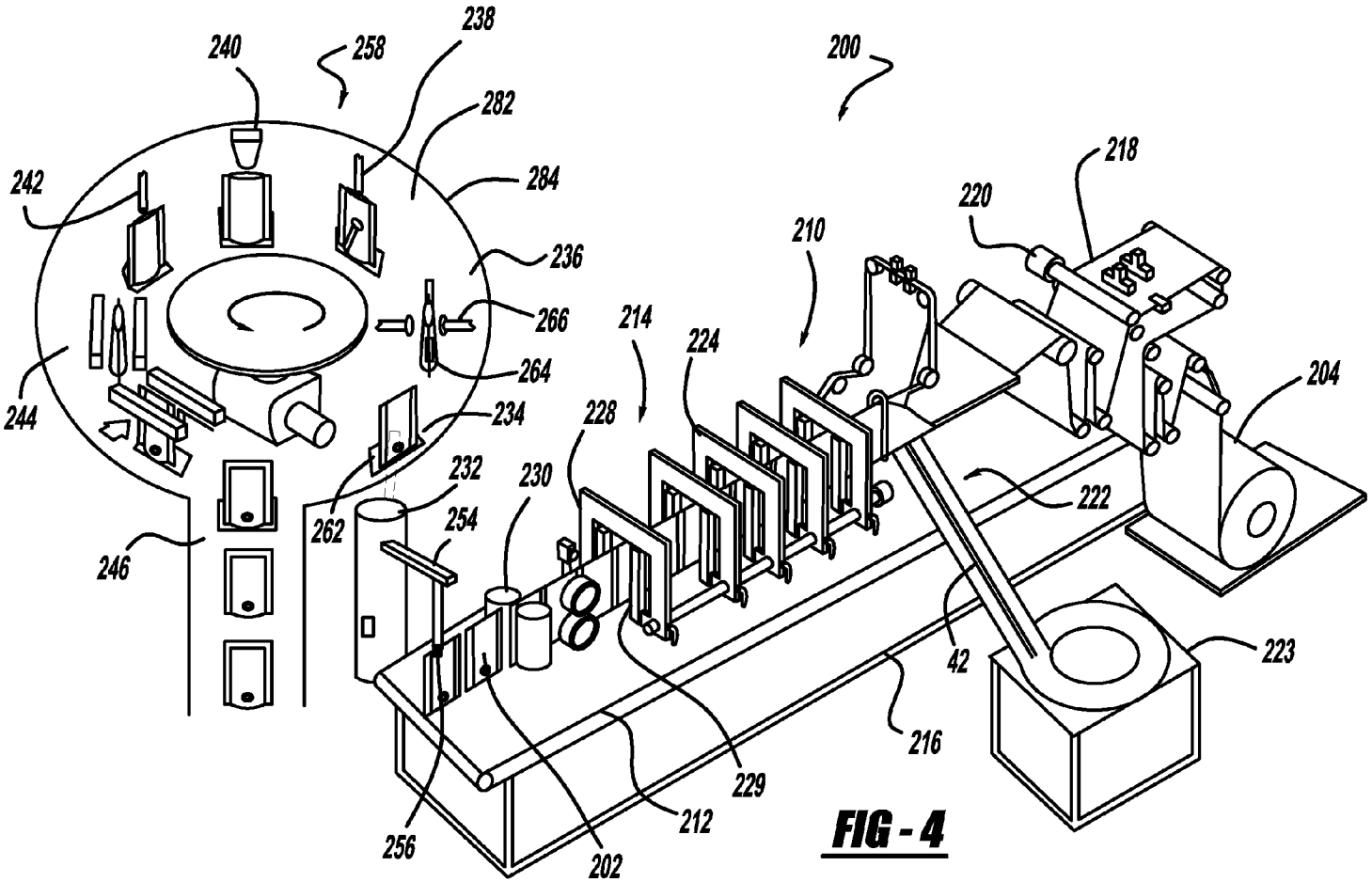
FIG. 4 is a perspective view illustrating a machine for forming, filling and sealing the flexible pouch, according to the present invention.

Referring to FIG. 3, a method for forming, filling and sealing the flexible pouch 10, such as that described with respect to FIGS. 1 or 2, using a high speed machine 200 as shown in FIGS. 4-11 is illustrated. The method may be implemented on various styles and combinations of machines, including be a form machine, a fill-seal machine, or a form-fill-seal machine. An example of a pouch forming machine is the Nishibe SMB500, SMB600 or SMB700. Another example is the Laudenberg form-fill-seal machine, FBM 10, 54, 20, 22.

The method begins in block 100 at a first station with the step of forming the body of the pouch 10. Various techniques may be utilized in forming the body portion of the pouch, depending on the predetermined shape of the pouch. As previously described, the body of the pouch may be formed from one or more panels of material that may be cut and positioned to form the front wall and a back wall of the pouch. Each wall panel has an inner surface and an outer surface, and an outer layer of the material 204 may include preprinted information. One layer of the material may also be preprinted with a tracking device 38, such as the RFID transmitter previously described. Preferably, several pouches are formed from one width of material. The material is removed from the roll, and may be cut into sections that are positioned to form the front wall and rear wall of the pouch. For example, a roll of a preprinted laminate material as previously described, is unrolled along a horizontally oriented plane. The initial width of the roll of material is determined by the desired finished size of the pouch and the number of pouches to be obtained from the width. In an example, two to four pouches representing four to eight wall panels can be obtained from a width of the roll of material on a machine having two or more lanes. The film may pass through an ultraviolet light chamber without reflection to remove pathogen and microbiological contaminants.

The material may be aligned. A precise alignment is advantageous, especially at a higher machine speed since it allows for provide a more precise seam tolerance and a contaminant reduction in the amount of material required. An example of an alignment method is disclosed in commonly assigned U.S. patent application Ser. No. 11/674,923, which is incorporated herein by reference. An example of aligning the material includes modifying the planar orientation of the unrolling material 204 from a horizontal orientation to a vertical planar orientation. The vertical orientation is advantageous in aligning the unrolling material 204 prior to cutting. The machine 200 may utilize an angled roll bar to modify the planar orientation of the unrolling material. An optical reader device may be utilized, such as an optical scanner or the like to identify a predetermined location of the material, such as an edge of the material or a registration mark. The determined alignment of the unrolling material may be used to automatically correct the alignment of the unrolling material. A moveable roller may be utilized to adjust the alignment of the material along a vertically oriented axis. For example, the adjustment movement is ±2 degrees from the vertically oriented axis.

The methodology advances to block 105, and a feature may be added to the pouch. For example, a sidewall or gusset 26 may be inserted between the walls of the pouch. In another example, the gusset 26, fold or pleat is formed in the panel using a folding operation to fold the panel. The gusset may have a "V" shape, and in another example, the gusset has a "W" shape. A plurality of apertures may be formed in the gusset, such as by using a punch. The plurality of apertures may be positioned in the gusseted portion of the material, so as to reduce the amount of material in the gusseted portion of the pouch for sealing purposes. The tracking device 38 may be advantageously located within an airspace 40 created by the aperture. Alternatively, the RFID transmitter may be secured on a surface of the panel in a predetermined position, so that it is located in an air pocket created during a later step. In another example, a shaping means, such as an insert may be positioned between the walls of the pouch. The shaping means may be positioned at any edge, such as a lower edge of the pouch or an upper edge. More than one shaping means may be utilized to achieve a desired shape. Still another example of a feature is a vent valve 24 inserted into one of the panels.

In addition, an opening means 28 may be applied at this time to the panels. For example, an opening means 28 such as a press-to-close zipper 42 may be applied to the panel walls 12, 14. The methodology advances to block 110.

In block 110, a seal is applied to the pouch in a sealing operation. The seal can be a permanent seal, a temporary seal, a rib, or a frangible seal. Various types of seals are available, such as a single seal, a double seal, or an insulating seal, or the like. Various sealing techniques are known in the art to form each seal, and a combination of sealing techniques may be utilized. The seals may be a heat weld formed by applying heat and compression, or an ultrasonic seal formed using vibrational energy, or a combination of heat and ultrasonic seals. It should be appreciated that a previous seal may be absorbed during the sealing process.

For example, the side edges and lower edges of the pouch 10 may be sealed, leaving the upper edges open, or all of the edges may be sealed. Other combinations are contemplated, depending on the type of fitment, product and filling technique. The side seal may be an overlap seal, whereby the side seal extends along the side edge of the panel and a predetermined distance along the upper edge. An angled top seal 44 may also be applied at this time. Advantageously, the seals may be shaped. For example, a radius on an outer edge may be rounded to avoid a sharp edge. A radius on an interior edge facilitates removal of the product.

A seal bar 229 or forming plate may be used to apply any of the seals. An example of a seal bar 229 is a generally rectangular member. The seal bar 229 may include a cavity used to create an air pocket, or to conform to the shape of a member. The seal bar or forming plate may have a plasma coating that makes the surface of the seal bar or forming plate more resilient. When the seal bar is heated, the coating expands due to this resiliency. The shear stress on the inner edge of the seal is reduced; resulting in reduced creepage of the material and greater durability of the seal. The plasma coating reduces the opportunity for potential damage to the material during the sealing step. In this example, the plasma coating is a smooth, hard plastic that mimics glass. Since the outer layer of material is not weakened, there is no creepage of the outer layer. An advantage of the plasma coating is that the line speed may increase.

In still another example of a sealing technique, the side seal is a two-step seal formed using more than one seal bar. One seal bar may include the previously described seal bar cavity for forming an air pocket in the sealed portion. An example of a two-step seal is disclosed in commonly assigned U.S. patent application Ser. No. 11/551,071. The two-step seal advantageously avoids the generation of ketones due to application of heat to the material. The first or inner seal is a low temperature seal. The second or outer seal is a high temperature seal. The second seal is spaced apart from the first seal by a predetermined distance, to create an air gap. The first seal is a tack seal, such as 6 mm wide, and is of a sufficient temperature so as to melt the layers of material and tack the edges together. The predetermined distance between the first and second seal is ½-1 mm. The second seal is applied at a higher temperature and pressure than the first seal. As a result, any gas, such as steam, ketones, aromatics or the like, is pushed in an outwardly direction, out through the open edges of the panels, and not into the pouch. Thus, the first seal prevents entry of contaminates into the pouch to avoid organoleptic contamination. The heat weld may include a heat weld followed by a cold weld. The methodology advances to block 115.

In block 115, the individual pouches formed in the roll width of material are separated from each other in a cutting operation. For example, each section of material may be first separated along its width, i.e. along the side seams of the pouches. The section is then is separated into individual pouches along a cutting line. In this example, the width of unrolling material represents the side edges. The material is cut into a pouch 10 using a known cutting apparatus, such as a laser or punch or the like. The cutting apparatus imparts a single cut in the material to separate the pouches. A single widthwise and lengthwise cut separates the web into individual pouches. Alternatively, two rows of pouches are cut out at one time by adding a double cut between two lengthwise cuts, preferably in the center. Advantageously, separating out multiple pouches during the cutting operation effectively doubles the assembly line speed.

In a further example, two consecutive pouches 10 may be separated using a double cutting process, whereby two cuts are made at the same time to separate the upper and lower edges of two pouches at the same time from the sheet of material. Advantageously, separating multiple pouches during the cutting operation effectively increases the assembly line speed.

The methodology advances to block 120 and the pouch is finished. For example, an edge may be trimmed so that the pouch may acquire a predetermined shape, or the pouch corners may be shaped to have a radius, or the like. A hanging aperture 48, if present, may be formed at this time. The trimming operation may be performed using a cutter or a die cut or the like.

In another example of a finishing operation, a crease or guide pocket may be formed in a top portion of each wall 12, 14 in a creasing operation, in order to facilitate opening and filling of the pouch. An example of a method of forming a crease in a wall to facilitate opening the pouch is disclosed in commonly assigned U.S. patent application Ser. No. 10/310,221, which is incorporated herein by reference. In still another example of a finishing operation, the sleeve is applied over the individual pouch and shrunk to fit using an application of heat to the pouch. In a further example of a finishing operation, a rib 50 may be added to the pouch. The rib may be thermoformed, and may provide the pouch 10 with shape or structure.

The methodology advances to 125, and the formed pouch 10 is removed from the form line by a transfer means. It should be appreciated that the fill-seal machine may be integral with the pouch forming machine, or may be a separate machine. The unfilled pouch may be loaded into a receptacle and the carrier is transferred to a fill-seal machine. In another example, the unfilled pouch may be directly placed on a fill-seal line using the transfer means. An example of a transfer means an individual, or a robotic transfer device, as disclosed in commonly assigned U.S. patent application Ser. No. 11/829,401, which is incorporated herein by reference. It is contemplated that the pouches 10 may be temporarily stored in a receptacle such as a magazine between the forming and filling operations. This increases the flexibility of the machine and may result in a manufacturing cost savings.

In block 130, the pouch is loaded onto the fill-seal line or machine 258. It should be appreciated that the pouches are unloaded and uniformly aligned. As previously described, the fill-seal line 258 can be integral with the pouch forming machine, or a separate fill-seal machine. The fill-seal line 258 can have stations arranged in a linear manner, or rotary or another configuration. For example, a line worker removes the pouch 10 from the form line or from the carrier, and places the pouch in a pouch carrier 262 on the fill-seal line 258. In another example, a robotic transfer device 252 is used to transfer the pouch from the either form line 210 or the receptacle to the fill-seal line 258. The robotic transfer device 252 can be a robotic device having an arm 254 and a gripping device 256 that picks up an individual pouch and places it in a pouch carrier 262 that moves between the fill-seal stations. An example is disclosed in commonly assigned U.S. patent application Ser. No. 11/829,401, which is incorporated herein by reference. Various types of pouch carriers 262 are available, such as a holder 262 or a gripper or the like. An example of a holder is a cup-shaped member, as disclosed in commonly assigned U.S. patent application Ser. No. 10/336,601, which is incorporated herein by reference.

The methodology advances to block 135, and the pouch 10 is partially opened in an opening operation. A pair of side edge grippers 264 hold the pouch along a side edge 20. A pair of opposed panel grippers 266 are positioned adjacent each of the front panel and the rear panel respectively. In this example, the panel grippers 266 are located near an upper edge of the front panel and real panel. The panel grippers 266 are of the suction vacuum type. To partially open the pouch, the side edge grippers 264 move inwardly towards each other while the suction panel grippers 266 adjacent each panel move in an outwardly direction away from each other.

Figure 9:
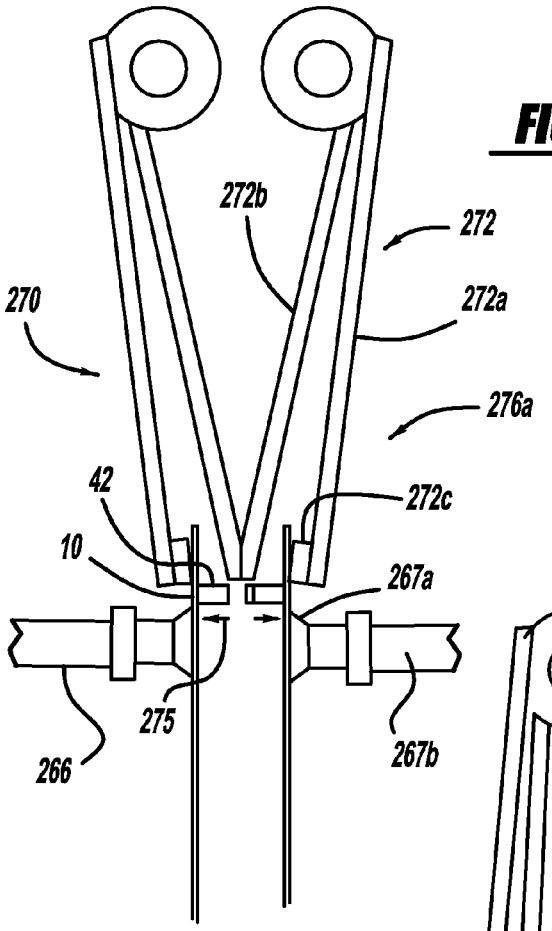
FIG. 9 is a cross-sectional view of the zipper fingers lowered into the pouch, according to the present invention.
Figure 10:
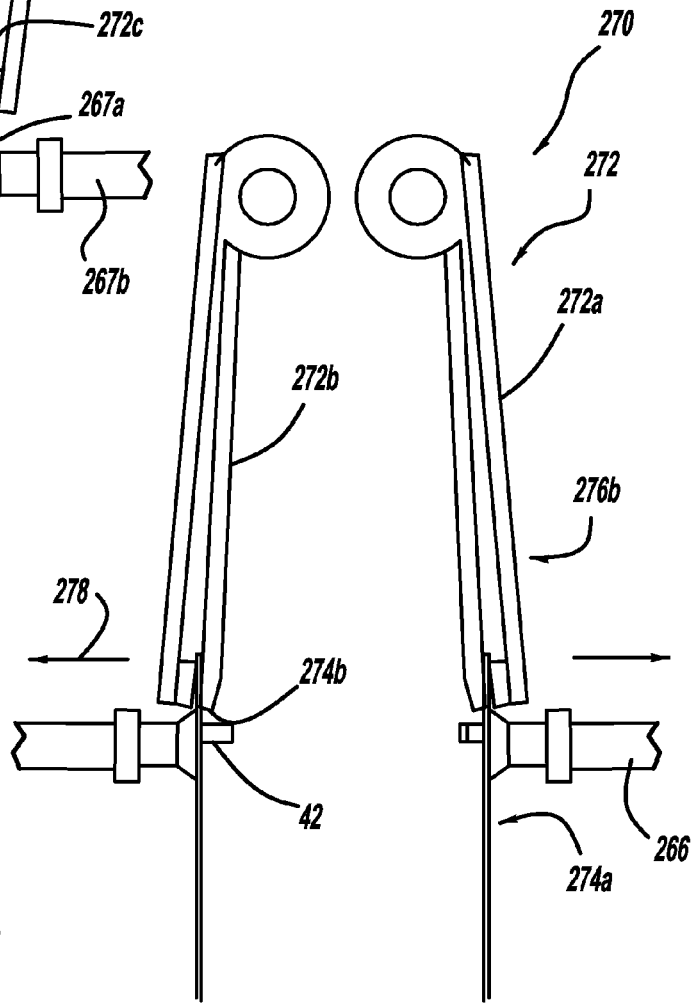
FIG. 10 is a cross-sectional view of the opened pouch, according to the present invention.
Figure 11:
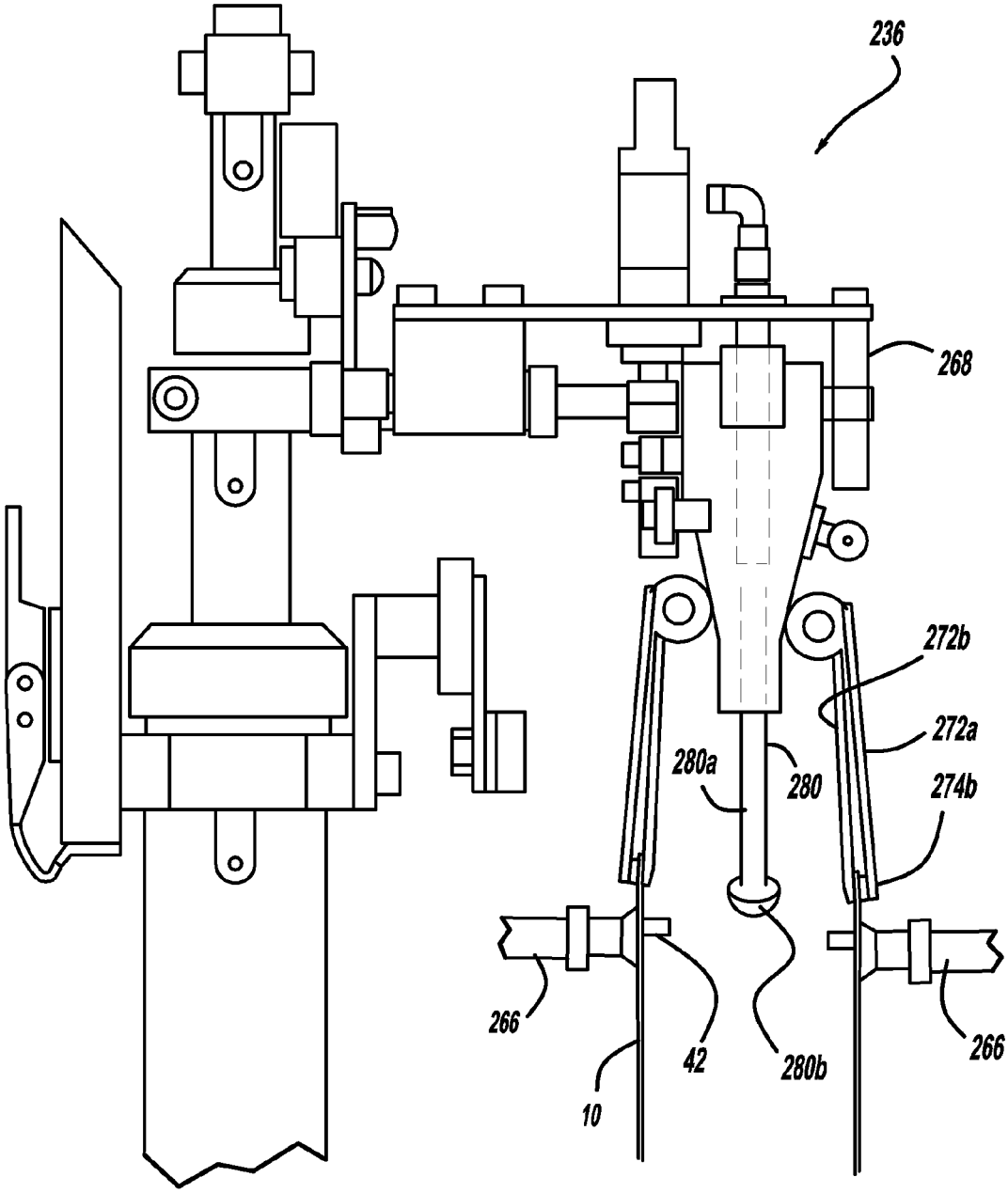
FIG. 11 is an elevational view of the opened pouch with the opening plunger, according to the present invention.

The methodology advances to block 140 and the pouch is fully opened using a pouch opening device. The pouch opening device 270 includes a pair of pouch opening fingers 272. The pouch opening fingers 272 are movable between an open position as shown at 274*a* representing a maximum separation between the fingers, and closed position representing a minimum separation as shown at 274*b*. In this example, there are two pairs of opposed pouch opening fingers 272. The pouch opening finger pair includes an outer opening finger 272*a* and an inner opening finger 272*b*. The pouch opening finger pair 272 is initially located in a raised position above the partially open edges of the pouch as shown at 276*a* and in an open pouch finger position 274*a*. In the open pouch finger position 274*a*, the inner opening fingers are adjacent each other, and the outer fingers are located outside the outer surface of each pouch wall. The opening fingers are lowered into the partially opened pouch as shown at 276*b*, so that the inner pouch opening fingers 272*b* are disposed between the open edges of the pouch, and each of the outer pouch opening fingers 272*a* are adjacent an outer surface of each pouch wall, as shown in FIG. 9. The inner pouch opening finger 272*b* is displaceable towards the outer pouch opening finger 272*a*, as shown at 275. The pair of pouch opening fingers 272 surround and grab a respective pouch wall. Each pair of pouch opening fingers 272 is displaced together in an outward direction, as shown at 278 to fully open the pouch by separating the walls of the pouch, as shown in FIG. 10.

Figure 5:
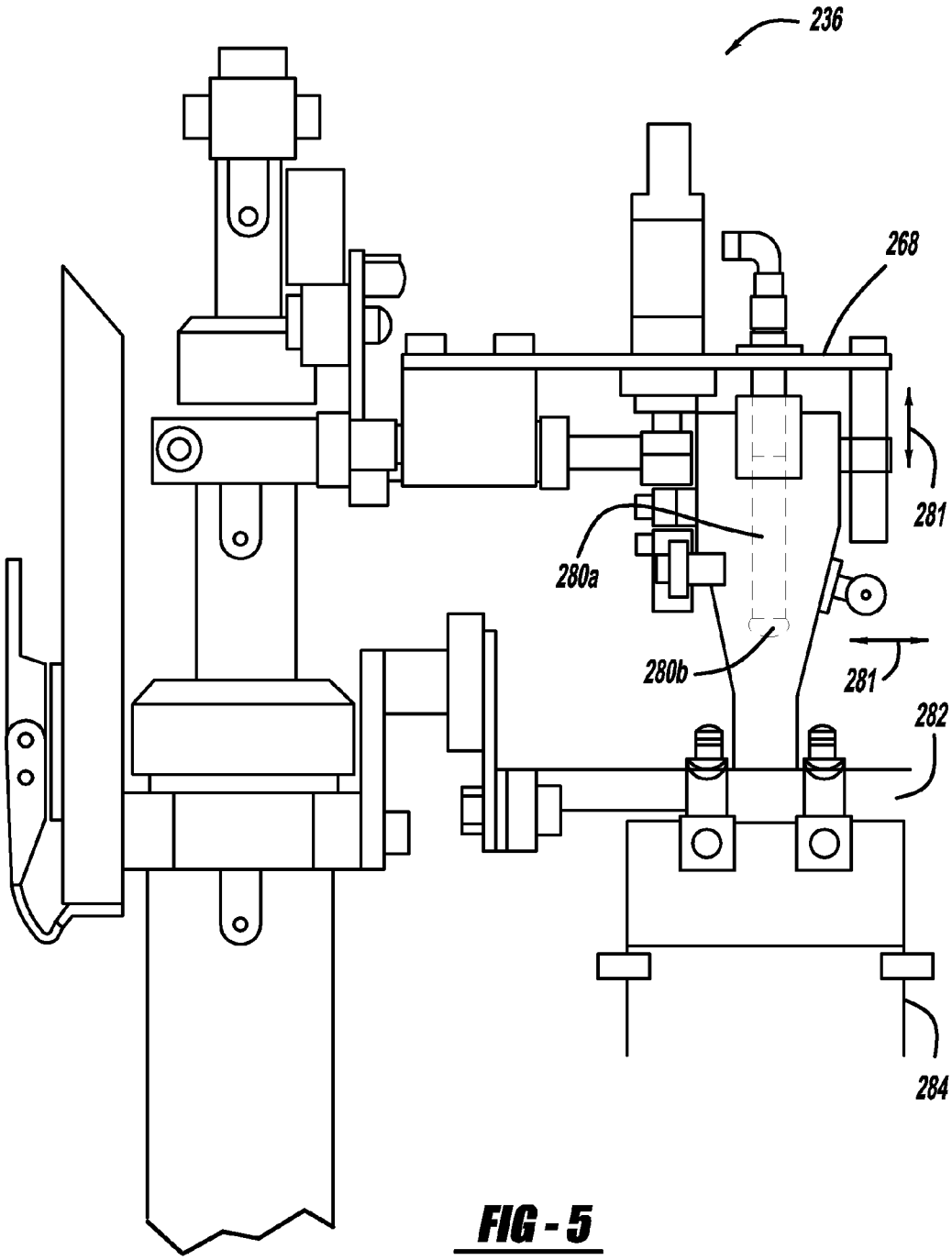
FIG. 5 is an elevational view of a pouch opening station for the machine of FIG. 4, according to the present invention.
Figure 6:
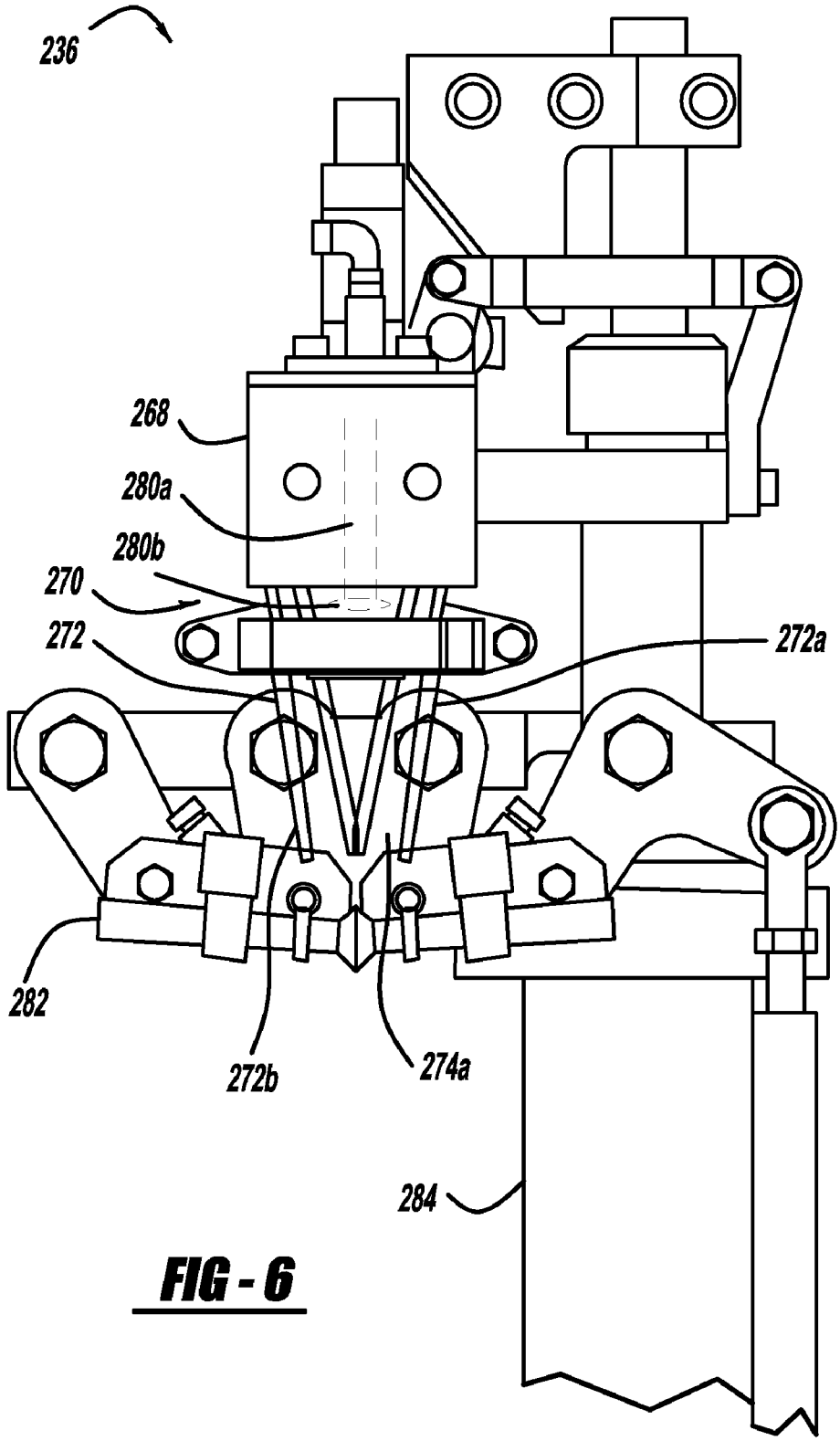
FIG. 6 is another elevational view of the pouch opening station of FIG. 5, according to the present invention.

In addition a pouch opening member 280 may be used to insure the fitment is fully opened. For example a plunger is lowered into the opened pouch. The pouch opening member 280 opens a zipper profile by moving back and forth along the length of the zipper, as shown in FIG. 5, in order to separate the teeth of the zipper and provide access to the interior of the pouch.

In addition, a nozzle (not shown) may be mechanically lowered into each pouch to direct a stream of compressed gas into the pouch, to force the walls of the pouch 10 away from each other. An example of a gas is carbon dioxide or nitrogen. The opening station may also include a blowing station having a manifold with a hood extending over the top of (not shown) the upper edges of the pouch 10, as is known in the art. The manifold has rows of apertures (not shown) formed above the upper edges of the pouch. The hood may be placed over the pouch 10 to assist in maintaining the air pressure in the pouch 10. The supply of pressurized gas is directed through the aperture to form a plurality of jets of pressurized gas or air. The jets are directed downwardly at the diamond-shaped openings formed at the upper edges to further assist in overcoming the surface tension of the pouch and assist in separation of the walls of each compartment. A diving rod (not shown) may then be used to make sure the pouch 10 is fully opened.

After the pouch is fully opened, the inner pouch opening fingers 272 return to the initial open finger position and the panel gripper and side edge gripper moves away from the pouch. It should be appreciated that the open zipper may be confirmed using a detect switch. The methodology advances to block 145.

In block 145, the pouch 10 is filled with the product in a filling operation. For example, a fill tube is lowered into the pouch a predetermined distance and the product is dispensed into the opened pouch. The product is preferably dispensed at a predetermined temperature, depending on the type of product. The fill tube may be raised out of the pouch at a predetermined rate as the product is dispensed. For example, the fill tube may be removed just ahead of the filling product.

If the product is naturally carbonated, such as a sparkling wine or the like, the pouch is preferably filled while immersed in a nitrogen or carbon dioxide atmosphere. If the product is not naturally carbonated and carbonation is desirable, it is immersed in a carbonator to introduce carbon dioxide into the product. For example, carbon dioxide is introduced into cold water or juice to provide a carbonated beverage. The product may contain a mixture of up to four volumes of carbon dioxide. It should be appreciated that the carbon dioxide masks any undesirable taste from ketones and other solvents released during the sealing process. The carbon dioxide also increases the pressure within the product so that the walls of the pouch are rigid after the top is sealed. The product is preferably filled at a temperature ranging from 29° F to ambient temperature. The filled pouch may have the oxygen removed from the pouch. For example, the pouch may be flushed with carbon dioxide. Any gas in the head space of the pouch is removed. For example, oxygen may be removed by applying a vacuum.

The pouches 10 may be moved to a station where any oxygen in the pouch residing above the product is removed, if necessary. This can be done by providing a hood or diving nozzle where oxygen is either evacuated or replaced with carbon dioxide or nitrogen into the pouch to displace the oxygen. A diving nozzle is used to inject the gas. The methodology advances to block 150.

In block 150 the pouch is closed. Various techniques are available for sealing the pouch 10. The seal technique depends on the product contained in the pouch, the pouch shape, or type of opening means or how the pouch is filled. The closing seal may be an ultrasonic seal or an ultra pulse seal or a heat weld or the like.

In an example of a zipper opening means, the open upper edge of the pouch is closed by engaging the zipper teeth. A closing seal 52 may be applied to the portion of the pouch outboard of the zipper, to seal the upper edges 16 together using a closing sealing process as previously described.

In an example of a pouch filled through the open edges with a carbonated product, or product having an alcoholic content, the open edges of the pouch are closed by applying a first closing seal. The first closing seal may be an ultrasonic seal, or an ultra pulse seal. An example of a closing seal for a pouch containing a carbonated product is described in commonly owned PCT Patent Application No. PCT/US03/034396 which is incorporated herein by reference.

A second closing seal may be applied a predetermined distance apart from the first seal. The second seal may be a heat weld or a cosmetic seal or an ultrasonic seal or the like. For a carbonated product, the location of the second seal is selected so that some of the product is trapped between the first and second seals. This is advantageous since it eliminates the potential for gas in the head space, i.e. the region between the product and the heat seal. The second seal is spaced outboard of the first seal. Another advantage of the location of the second seal is that the overall length of the pouch may be reduced, resulting in less pouch material. In a further example, the first closing seal is a tack seal, and the second closing seal is a high pressure, high temperature seal. A cosmetic seal may be applied with respect to the first and second closing seals, or the second seal may be a cosmetic seal. In an example of an overlap seal, the closing seal extends a predetermined amount over the side seal along the upper edge.

In yet another example of a pouch 10 having a spout fitment 36, the cap 34 is applied the spout 36 to close the pouch 10. The cap 34 contains the product in the filled pouch, to prevent leakage of the product from the pouch 10. The cap 34 may be a tamper-evident cap for a carbonated product.

In block 155, the filled pouch 10 is finished in a finishing operation. For example, the edges of the pouch may be trimmed to achieve a predetermined pouch shape. In addition, the filled pouch may be cooled at a cooling station using a conventionally known cooling technique. Optionally, the sleeve may be placed over the filled pouch and shrunk to fit over the pouch by applying heat. The sleeve layer forms an outer layer of the pouch. The methodology advances to block 160.

In block 160, the filled pouch 10 is discharged from the machine. A plurality of pouches may be placed in a package for sales or shipping purposes. The pouch is available for additional processing if desired. For example, the pouches are moved to a discharge station 232. A robotic transfer device 252 may be used to remove the pouch from the carrier 262. The carriers may then be moved by the conveyor through a rinsing station and returned to the other side of the machine for use. The pouches 10 may be placed into cartons. At this point, the filled pouch is available for distribution or additional processing. For example, the filled pouch may be pasteurized in an integral retort chamber (not shown) that heats and then cools the pouch. The pouch may be tested, such as burst testing or the like prior to packaging for shipping. These additional processing steps may take place at a station on the form/fill/seal apparatus, or on another apparatus.

It is contemplated that the order of implementing the steps may vary to facilitate the manufacturing process. In addition, a manufacturing station may perform one or a plurality of operations, to enhance the efficiency of the methodology and apparatus. It should be appreciated that the methodology may include other steps, such as an upstream oxygen purging station, a downstream oxygen purging station, or pasteurization or the like. It is also contemplated that the order of implementing the steps may vary to facilitate the manufacturing process.

Referring to FIGS. 4-11, a machine 200 for carrying out the method described with respect to FIG. 3 for the pouch of FIGS. 1-2 is illustrated. Various styles of machines 200 are contemplated for forming or filling and sealing the pouch 10, such as a flat bed, conveyor or the like. An example of such a machine is manufactured by Nishibe, such as the model number SBM500, SMB600 or SMB700. The machine 200 may include form stations 210 and/or fill-seal stations 258. It should be appreciated that a particular manufacturing station may perform one or a plurality of operations, to enhance the efficiency of the methodology and apparatus. The stations may be arranged in a linear manner, rotary manner, or a combination thereof.

The machine includes a base 216 and a transport device 212 that transports the material through the various stations. Various styles of transport devices are contemplated, and a particular machine may include more than one style. An example of a transport device is a conveyor, rollers, a turret or the like. The roll of material 204 is initially mounted along a horizontally oriented axis, and is unrolled along at a material feed station.

The machine 200 includes an alignment station 218 that aligns the unrolling material 204. For example, at the alignment station 218, the material rolls pass through sensing device, such as an optical reader, that identifies a predefined point on the material 204. This predefined point may be a registration mark on the material, or the edge of the material 204. The machine 200 utilizes the registration marks to automatically adjust the orientation of the unrolling material position along an axis. For example, rollers 220 are used to adjust the position of the unrolling material ±2 degrees relative to a vertically oriented center axis.

The machine may include a fitment application station 222 that applies an opening means 28, such as a zipper fitment to the unrolling material at a predetermined location on the material. The machine includes a feeder mechanism 223, which supplies the zipper 42 to the machine. In this example, a feeder mechanism 223 supplies the unrolling material roll with pre-applied zipper at a 90 degree angle to the direction of material 204 flow. It should be appreciated that the zipper fitment may be simultaneously applied across all lanes in the predetermined panel location. For example, in a 10 lane machine with 10 panels, arranged in a linear line of 10, 10 fitments are simultaneously sealed to the material. At a rate of 50 strokes per minute, 500 fitments per minute may be applied to the unrolling material.

The machine includes a cutting station 224 where the material is cut into a predetermined number of sections. For a pouch made from two panels of material, one of the sections is rotated 180 degrees, and the first and second sections of this example are positioned such that inner sides face one another. The sections are used to form the front panel and back panel of the pouch, respectively.

The machine may include a feature insertion station that adds a feature, as previously described, between the facing sheets of material. The facing sections are transferred along the conveyer to a sealing station.

The machine includes a sealing station 228 that applies a seal to the pouch. Various sealing techniques are known in the art, and depend on the application. The seal may be a heat weld formed by applying heat and compression, or an ultrasonic seal formed using vibrational energy, or a combination of heat and ultrasonic seals. In addition, a previous seal may be absorbed during the sealing process. An example of some applications includes to seal an edge of the pouch, secure a fitment to the pouch, form a rib or another thermoformed feature.

The sealing station may include a seal bar 229 to apply the seal. In an example, there are two opposed seal bars, and the pouch fits between the seal bars. The seal bar may include a cavity surface that corresponds to a predetermined shape. The cavity may be for sealing a fitment, or creating an airspace or the like. The sealing station 228 may form the seams joining the edge of each panel to delineate each pouch. In this example, the side edges of each of the pouches along the width of material are heat-sealed. By precise alignment of the material sheets, the width of the side edge seam may be reduced, such as 4 mm, with a tolerance of ±1 mm.

The machine includes a cutting station 230 and the sealed panels are separated into individual pouches. For example, the pouch is separated along an edge seam. The pouch may also be separated from the unrolling material along the upper edge and lower edge. The cut may be a double cut, so as to separate two pouches at one time. It should be appreciated that the pouches 10 are fully formed, and are now ready for filling.

The machine includes an unloading station 232. The transport device transfers the individual pouches to an unloading station 232, wherein the individual pouches are removed. The pouches may be placed into a receptacle, such as a holder, or magazine or the like. In this example, the pouches may be placed directly on a fill-seal line 258 associated with the machine, using a robotic transfer device 252, as previously described.

For a form-fill-seal machine, the line speed between the form stations 210 and the fill-seal stations 258 can be coordinated to output filled pouches at a predetermined rate, and such coordination may increase the overall pouch production rate. The fill-seal line 258 includes a pouch receiving station 234 for receiving the pouch that includes a pouch carrier 262 that moves the pouch, arranged in a predetermined manner, through each of the stations in the fill-seal line 258. The fill-seal stations may be associated with a second frame 284. The stations of the fill seal line 258 of the machine 200 may be arranged in various configurations, such as a linear manner, or a circular manner. An example of a circular transport means is a rotational transport table. The linearly arranged stations may be further oriented transversely or vertically. Various types of pouch carriers are available, such as a holder 262 or a gripper, a combination thereof or the like. An example of a holder 262 is a cup-shaped member, as disclosed in commonly assigned U.S. patent application Ser. No. 10/336,601, which is incorporated herein by reference. In this example, in addition to a holder 262, a pair of opposed side edge grippers 264 each hold a corresponding side edge of the pouch. The side edge grippers 264 may be operatively connected to an actuating device 268 for displacing the side edge gripper in the manner described to open the pouch. The holder 262 is operatively connected to a transport device 282, as previously described, for moving the pouch carrier between stations.

The machine includes an opening station 236, in order to separate the upper edges of the pouch for filling. The opening station 236 includes panel grippers 266 that grip the outside panels of the pouch. The panel gripper 266 includes a gripping member 267*a* positioned on an end of an arm 267*b*. The arm is attached to an actuating device 268 for simultaneously moving the panel gripper 266 and side edge grippers 264 in predetermined directions. The gripping member 267*a* is a suction cup that relies on the creation of a vacuum in order to grip the pouch. Other types of gripping members may be used, such as fingers or the like.

Figure 12:
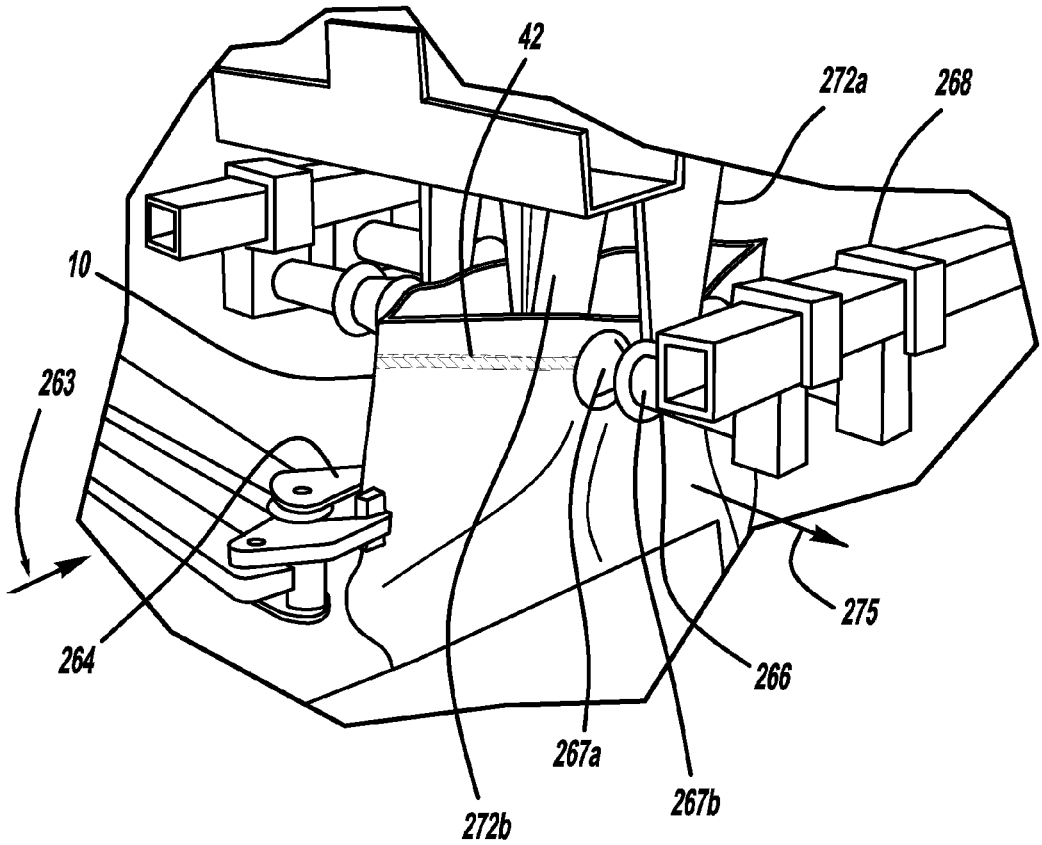
FIG. 12 is a partial elevational view of the zipper fingers lowered into the pouch, according to the present invention.

There are two opposed panel grippers 266, and the pouch 10 is positioned between the opposed panel grippers 266, so that each panel gripper 266 is adjacent an outer surface of the front wall 12 and back wall 14 respectively. In this example, the panel grippers 266 are located near an uppermost edge of the front wall 12 and back wall 14. To partially open the pouch, the side edge grippers 264 are moved inwardly towards each other as shown at 263 in FIG. 12 while the panel grippers 266 holding the outer surface of each panel are displaced in an outwardly direction perpendicular or to the orientation of the pouch as shown at 275 in FIG. 12.

Figure 7:
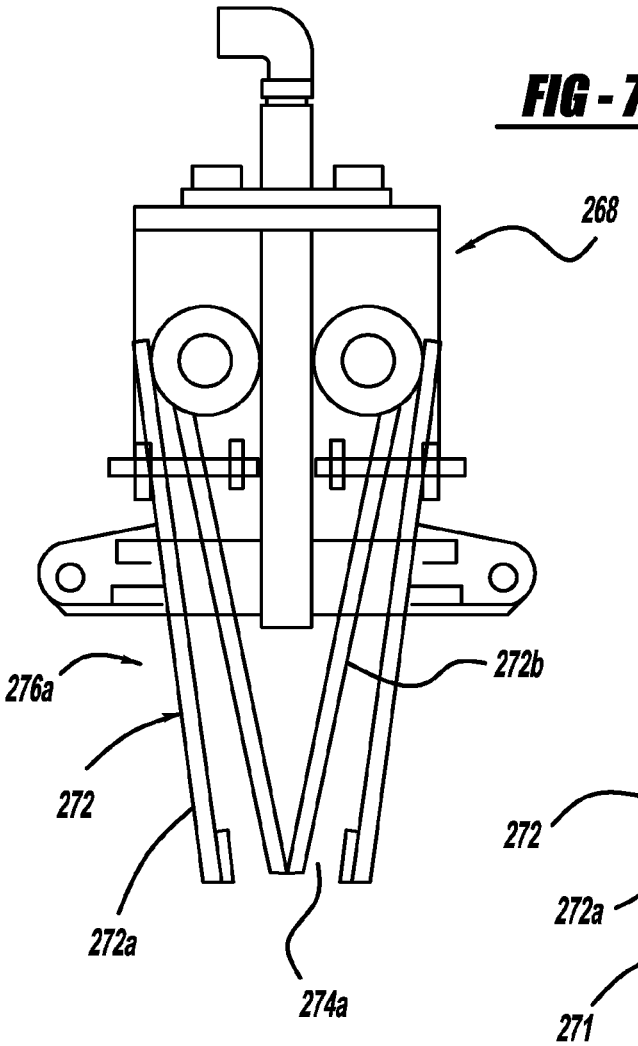
FIG. 7 is a cross-sectional view of the zipper fingers in an open position prior to lowering into a pouch, according to the present invention.
Figure 8:
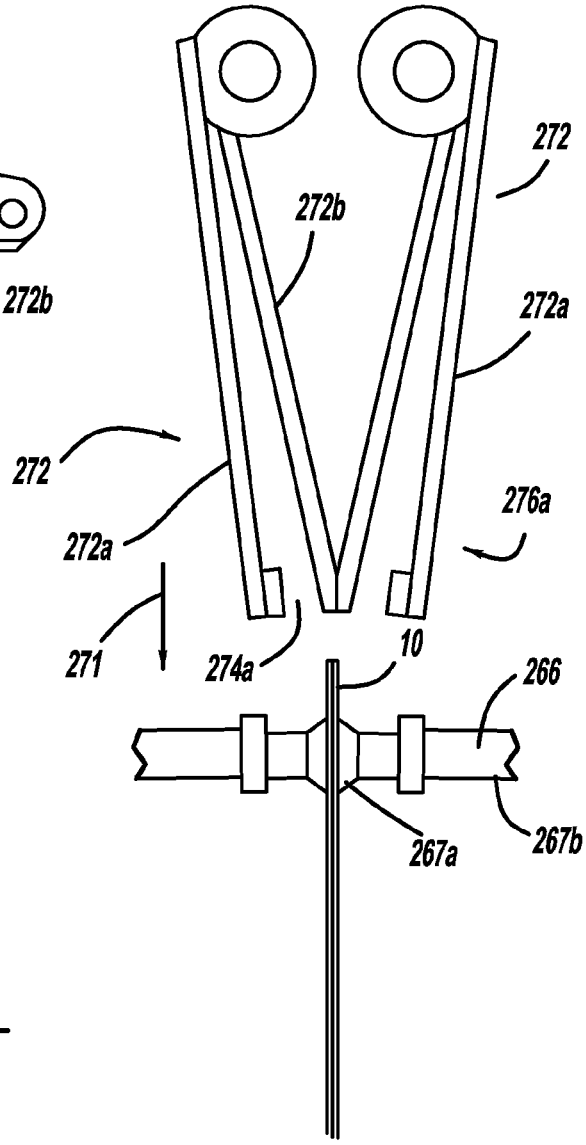
FIG. 8 is another cross-sectional view of the zipper fingers in a closed position, according to the present invention.

The opening station 236 also includes a pouch opening device 270 (FIG. 6) for fully opening the pouch. The pouch opening device 270 includes at least one pair of pouch opening fingers 272. The pouch opening finger pair 272 includes an outer opening finger 272*a* and an inner opening finger 272*b*. In this example, each of the pouch opening fingers 272 is a generally rectangular bar. A lower end of the bar may include a gripping surface 272*c* as shown in FIG. 9 that is in contact with the pouch. The upper end of the bar is secured to actuating device 268 as shown in FIG. 7. The actuating device 268 can be located above the pouch opening device 270 as shown in the figures and controls the movement of the pouch opening device between various positions, such as a finger open position 274*a*, a finger closed position 274*b*, a finger raised position 276*a* and a finger lowered position 276*b* or an outward opening position 278. The actuating device includes a motor, a controller or other actuating linkage, or the like utilized mechanisms for performing the desired opening operation in a predetermined sequence.

The finger closed position 274*b* represents a minimum separation between a pair of fingers to grip the pouch wall, and the finger open position 274*a* representing a maximum separation between a pair of fingers. In this example, there are two pairs of opposed opening fingers. The pairs of pouch opening fingers initially have an open finger position 274*a*, and are located in a raised position 276*a* above the partially open edges of the pouch. In the finger lowered position 276*b*, an edge of each of the inner opening fingers are adjacent each other, and the gripping surface 272*c* of each of the outer fingers are located adjacent the outer surface of each pouch wall. The actuating device 268 lowers the pair of pouch opening fingers 272 into the partially opened pouch shown in FIG. 9 in the direction shown at 271 of FIG. 8, so that the gripping surface of each of the inner fingers 272*b* is adjacent an inner surface of the pouch wall, and the gripping surface 272*c* of the outer fingers 272*a* are positioned adjacent an outer surface of each pouch wall, into the partially opened pouch, as shown in FIG. 9. The pair of pouch opening fingers 272 come together to grip the wall disposed therebetween as shown in FIG. 10, and the actuating mechanism 268 operatively displaces each pair of pouch opening fingers in an opposite direction away from each other as shown at 278, i.e. an outward direction, to fully open the pouch by separating the walls of the pouch, as shown in FIG 10.

The opening station 236 also includes a pouch opening member 280 operatively controlled by the actuating mechanism 268. The pouch opening member includes an arm 280*a* and a head 280*b* located on a distal end of the arm 280*a*. The proximate end of the arm is secured to the actuating mechanism, for displacement of the pouch opening member into the pouch. The head portion may assume various shapes, depending on the type of fitment. In this example, the head portion 280*b* is a plunger which has a semi-spherical shape. The actuating device 268 positions the opener 280*b* between the open edges of the pouch to insure the fitment is open. For example, the pouch opening member 280 insures the zipper is open by simultaneously moving up and down while traveling back and forth along the length of the zipper, as shown at 281 in FIG. 5, in order to separate the teeth of the zipper and provide access to the interior of the pouch.

After the pouch is fully opened, a stream of heated air may be directed toward the upper edges of the pouch, or through the spout. In addition, a nozzle may be mechanically lowered into the pouch opened 10. The nozzle is secured to a gas supply means. For example, a stream of compressed gas downwardly into the pouch to further force the walls of the pouch 10 away from each other to further the pouch as shown at 238. An example of a gas is carbon dioxide or nitrogen.

In addition, the opening station 238 may include a manifold, with a hood extending over the top of the edges of the pouch. The manifold has rows of apertures (not shown) formed above the upper edges of the walls of the pouch. The hood is placed over the pouch to assist in maintaining the air pressure in the pouch. The supply of pressurized gas is directed through the aperture to form a plurality of jets of pressurized gas or air. The jets are directed downwardly at the diamond-shaped openings formed at the upper edges to assist in overcoming the surface tension of the walls and assist in separation of the walls. A diving rod may then be used to make sure the pouch is fully opened. Steam or another type of sterilizer may be utilized to clean an inside wall of the opened pouch.

The opened pouch moves to a filling station 240, and the pouch is filled with the product. For example, a product is stored in a storage device, and one end of a feed line is in communication with the product in the storage device. The other end of the feed line is secured to a nozzle that dispenses a predetermined amount of product into the opened pouch. The product may be dispensed directly through the opened edges of the pouch or through the spout. The feed line is operatively controlled by an actuator that lowers the nozzle into the opened pouch, and dispenses the product into the opened pouch. The nozzle may be raised at a predetermined rate out of the pouch that corresponds to the rate of filling the pouch. The controlled delivery of product may reduce any overspray. Depending on the size of the pouch, there may be multiple fill nozzles or fill stations.

If carbonation is desired, and the product is naturally carbonated, such as beer or soda or the like, the pouch may be filled while immersed in a nitrogen atmosphere. If the product is not naturally carbonated, it may be immersed in a carbonator to introduce carbon dioxide into the product. For example, carbon dioxide is introduced into cold water or juice to provide a carbonated beverage. The product may contain a mixture of up to four volumes of carbon dioxide. It should be appreciated that the carbon dioxide may also mask any undesirable taste from ketones and other solvents released during the sealing process. The carbon dioxide also increases the pressure within the product so that the walls of the pouch 10 are rigid after the top is sealed. The product is preferably filled at a temperature ranging from 29° F. to ambient temperature.

The carbonation is also advantageous as a microbiocide that can enhance the flavor or prevent mold or contamination.

The machine includes a gas removal station for removing any oxygen from the pouch as shown at 242. The gas removal station may include a hood that evacuates the oxygen, or a diving nozzle that delivers a gas, such as carbon dioxide or nitrogen, or liquid nitrogen or the like, into the pouch to displace the oxygen.

The machine includes a closing station 244 that closes the pouch. The filled pouch may also return to a partially closed position due to the product contained therein. The grippers are moved in a direction opposite the pouch, to close the upper edge of the pouch by increasing the tension in the walls of the pouch. In an example of a pouch includes a zipper fitment, the zipper is closed using a closing apparatus that engages the zipper, and a portion of the pouch outboard of the zipper may be sealed. In another example of a pouch filled through the open edges of the pouch, the closed edges of the pouch are sealed using a closing seal. The closing seal may be a thermal seal. For example, a moveable heat sealing member is positioned over the upper edge of the pouch to seal the upper edges together through the application of heat or heat and pressure. As previously described, the heat sealing member may have a plasma coating. Another example of a closing seal for a product utilizes an ultrasonic sealing process that includes a first closing seal. The ultrasonic seal may include sound waves and is formed using a horn and anvil.

The machine may include a second closing station for applying a second closing seal. The second closing seal may be applied using a heat seal means to form a second heat seal spaced apart a predetermined distance from the first closing seal. It should be appreciated that the second closing seal may be spaced slightly outboard of the first closing seal. The second heat-sealing station is conventional and utilizes heat or a combination of heat and pressure to form the seal. The second closing seal may also be a cosmetic seal or another type of seal, such as ultrasonic, ultra pulse or the like. The first and second seals are applied for a carbonated product as disclosed in commonly assigned Patent Application No. PCT/US03/34396, which is incorporated herein by reference.

If the pouch 10 is filled through the spout fitment 36, the pouch 10 is closed by securing a cap 34 to the spout 36 using a cap application device. The cap 34 may have a tamper-evident feature. In addition, the cap 34 may contain a tracking device 38.

The machine includes a removal station 246 for finishing and removing the pouch from the machine 200. A feature, such as a hanging aperture 48, may be formed at this time using a cutting device, such as a punch. In another example of a finishing operation, the edges of the pouch 10 may be trimmed to achieve a desired shape using a cutting device.

The machine includes a pouch transfer device such as a robotic transfer device for removing the pouches 10 from the machine 200. The pouch may be placed into a box or moved to another device or machine for additional processing.

It should be appreciated that the automated machine 200 may include other operations. For example, the filled pouch may be transferred to another transport device, or otherwise collected. Alternatively, other stations may include a straw pierceable opening station, an upstream oxygen purging station, downstream oxygen purging station, or the like. In another example, the pouch is transferred to a packaging machine, which may be integral with the fill-seal machine or a separate line. Still another example of additional processing is the pouch may be transferred to a pasteurization station. Pasteurization enhances the shelf life of the product. The pouch is inserted into an enclosed chamber. For example, a combination of steam and water is used to heat the pouch to a predetermined temperature for a predetermined period of time to pasteurize the product contained within the pouch. The package is then cooled. In this example, recirculated water surrounds the pouch cool the pouch. In certain instances, it may be desirable to apply steam to sterilize the pouch 10 and to wet the inner surface of the walls to facilitate handling.

The present invention has been described in an illustrative manner. It is to be understood that the terminology which has been used is intended to be in the nature of words of description rather than of limitation.

Many modifications and variations of the present invention are possible in light of the above teachings. Therefore, the present invention may be practiced other than as specifically described.

The invention claimed is:

1. An apparatus for opening a flexible pouch having a wall and an opening means integrally formed in the wall for accessing a product contained within the pouch, comprising:

an actuating device;

a pair of opposed side grippers each holding a side of the pouch operatively connected to said actuating device;

a pair of opposed panel grippers each holding an upper edge of the pouch and operatively connected to said actuating device;

a pouch opening device having two pair of pouch opening fingers operatively connected to said actuating device;

each of said pair of pouch opening fingers having an outer opening finger and an inner opening finger with each of said outer opening fingers and said inner opening fingers extending downwardly from said actuating device;

said actuating device operable to move each of said pair of pouch opening fingers together and apart.

2. The apparatus of claim 1 further including a pouch opening member displaceable between a raised position above the pouch and a lowered position within the pouch, for checking if the pouch opening means is fully opened, wherein the pouch opening member includes an arm and a head on a distal end of the arm that is received into the opening means.

3. The apparatus of claim 1 wherein the opening means is a zipper.

4. The apparatus of claim 1 further including a pouch opening member that operatively unlocks the pouch opening means, wherein the opening means is a zipper having interlocking teeth, and the pouch opening member is displaced along a length of the zipper to separate the zipper teeth.

5. The apparatus of claim 1 wherein the pouch opening member includes an arm and a head on a distal end of the arm, for separating the teeth of the zipper by moving both vertically and horizontally along the zipper.

6. The apparatus of claim 1, wherein each of said pair of pouch opening fingers has a finger open position, a finger closed position, a finger raised position, a finger lowered position and an outward opening position.

7. The apparatus of claim 6, wherein each of said pair of pouch opening fingers are in said finger open position when said pouch opening device is in said finger raised position.

8. The apparatus of claim 1, wherein one of said inner opening fingers has an edge adjacent the other said inner opening finger and each of said outer opening fingers has a gripping surface adjacent an outer surface of the wall of the pouch when said pouch opening device is in said finger lowered position.

9. The apparatus of claim 1, wherein each of said inner opening fingers has a surface adjacent an inner surface of the wall of the pouch when said opening device is in said outward opening position.

10. The apparatus of claim 1, wherein said inner opening finger and said outer opening finger of each of said pair of pouch opening fingers has a minimum separation therebetween and grips the wall of the pouch when said opening device is in said outward opening position.

11. The apparatus of claim 1, wherein said actuating device is operable to move each of said pair of pouch opening fingers to said finger open position, said finger closed position, said finger raised position, said finger lowered position and said outward opening position.

* * * * *